US005419869A

United States Patent [19]

Choi et al.

[11] Patent Number: 5,419,869

[45] Date of Patent: May 30, 1995

[54] HEAT RESISTANT NI-CR-W BASE ALLOY

[75] Inventors: Ju Choi; Hyon T. Kim, both of Seoul, Rep. of Korea

[73] Assignee: Korea Institute of Science and Technology, Seoul, Rep. of Korea

[21] Appl. No.: 167,461

[22] Filed: Dec. 15, 1993

[30] Foreign Application Priority Data

Dec. 17, 1992 [KR] Rep. of Korea ..... 24708/1992

[51] Int. Cl.[6] ..... C22C 19/05

[52] U.S. Cl. ..... 420/448; 420/588; 148/410; 148/428

[58] Field of Search ..... 420/448, 588; 148/410, 148/428, 419, 442

[56] References Cited

U.S. PATENT DOCUMENTS 4,006,015 2/1977 Watanabe et al. ..... 420/448

4,810,466 3/1989 Choi et al. ..... 420/448

5,141,704 8/1992 Kondo et al. ..... 420/448

FOREIGN PATENT DOCUMENTS 2103243A 2/1983 United Kingdom .

*Primary Examiner*—Scott Kastler

*Assistant Examiner*—Margery S. Phipps

*Attorney, Agent, or Firm*—Lowe, Price, LeBlanc & Becker

[57] ABSTRACT

An Ni—Cr—W base alloy having superior creep strength and excellent corrosion resistance consists essentially of: by weight 21 to 25% of Cr, 18 to 25% of W, 0.5 to 2.0% Ti, 1 to 5% of Al, between zero and 0.2% of B, 0.025 to 0.5% of C, between zero and 0.3% of Zr and 0.3 to 3.0% of Ta, the balance being substantially Ni.

6 Claims, 1 Drawing Sheet

HEAT RESISTANT NI-CR-W BASE ALLOY

BACKGROUND OF THE INVENTION

Elevating the operating temperature is considered to be most effective for increasing the thermal efficiency of power generators or chemical planting. For this purpose, the development of materials exhibiting superior creep strength and corrosion resistance is required. Many Ni—Cr—W base alloys which exhibit high creep strength and corrosion resistance have been developed without the deterioration of other mechanical properties. For instance, such alloys include Ni—Cr—W alloy disclosed in United Kingdom patent No. 2103243A and heat, resistance Ni—Cr—W—Al—Ti—Ta alloy disclosed in U.S. Pat. No. 4,810,466. The former alloy has a good creep strength and fatigue properties, but has poor forgeability. The latter alloy has excellent creep strength and corrosion resistance as well as a good workability. However, it has been proved that forgeability is still insufficient for the mass production of the alloy.

This invention relates to an novel Ni—Cr—W base alloy having superior creep rupture strength and corrosion resistance as well as excellent forgeability.

SUMMARY OF THE INVENTION

It is an object of the present invention to provide an improved alloy based on the Ni—Cr—W—Al—Ti—Ta alloy of U.S. Pat. No. 4,810,466. This invention is accomplished by the more addition of Cr and the adjustment of B content in the alloy. The creep rupture strength of the alloy of the present invention is remarkably increased 3.6 times when compared with the alloys off U.S. Pat. No. 4,810,466 under the condition of 5 $Kg/mm^2$ of stress at 1000° C. when 21 to 25% of Cr is added and less than 0.2% of B by weight is adjusted on the basis of U.S. Pat. No. 4,810,466. And also, the alloy of this invention exhibits a excellent, workability and hence, can easily be formed into the various shapes such as rods, plates, and tubes, etc. It is also found that the present alloy exhibits excellent corrosion resistance under the environments of strong acids such as hydrochloric acid, nitric acid, sulfuric acid or phosphoric acid as well as an oxidation resistance.

DETAILED DESCRIPTION OF THE PREFERRED EMBODIMENT

Figure 1:
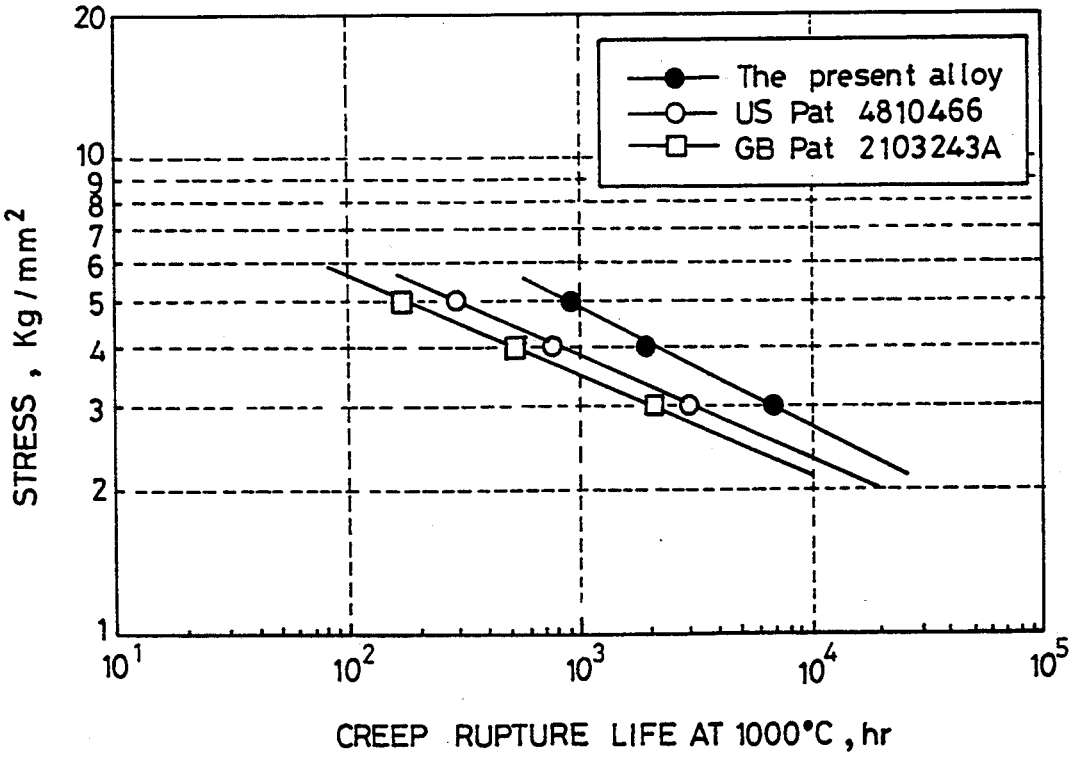
FIG. 1 shows the result of creep rupture test of the alloy the present invention when compared with other Ni—Cr—W base alloys.

The alloy of the present invention comprises essentially of 21 to 25% of Cr, 18 to 25% of W, 0.5 to 3.0% Ti, 1 to 5% of Al, less than 0.2% of B, 0.025 to 0.5% of C, less than 0.3% of Zr and less than 0.3 to 3.0% of Ta with the balance of Ni.

The limitations of the proportions of the alloying elements to the defined ranges have been set for the following reasons: Cr is very effective element for increasing corrosion resistance as well as creep strength of the alloy, and dissolves in a large amount in the matrix of the alloy to serve for the solid solution strengthening of the matrix. The Cr content exceeding 25% undersirably degrades the high temperature strength of the alloy, and if the Cr content is less than 21% solid solution strengthening effects and corrosion resistance are insufficient. As is well known, B forms various types of borides to strengthen the grain boundary of the alloy. In order to obtain this effect sufficiently, the content of B should be less than 0.2%. Al and Ti are elements required for forming the gamma prime phase. The amount of Al should be at least 1% in order to strengthen the alloy sufficiently by precipitation. If the amount of Al is more than 5%, the workability of the alloy is decreased because of the precipitation of a large amount of gamma prime phase in the matrix during hot working. Furthemore, the addition of Ta elevates the creep rupture strength at 1000° C. by the solid solution of Ta into both matrix and gamma prime precipitates In the alloy, the precipitate alpha tungsten which comprises of W, Cr and Ni is also found to be in the matrix these precipitates provide the alloy with precipitation hardening effect. C plays an important role by forming various types of carbides at the grain boundary. An optimum amount of carbides contributes to the strengthening. However, excessive carbides bring out the reduction of workability. The purpose of the addition of Zr is to strengthen the grain boundary and to stabilize the carbides. The excessive amount of Zr contributes to a grain boundary embrittlement which brings out poor workability.

EXAMPLE

The purity of raw materials used for the alloy were chosen as high as 99.9%. A flake type of electrolytic Cr with 99.95% of purity was used. W was used as an metal powder, B was added with the mother alloy Ni-1.5% and C was added as high purity graphite. Al pellets with 99.99% of purity, Ti sponge with 99.9% of purity and Ta pellets with 99.99% of purity were used. An alloy was melted in a high frequency vacuum induction melting furnace under a pressure of $10^{-3}$ torr. The procedure of ingot making process is as follows: Ni, W. graphite were charged and melted, following up the addition of Cr. Subsequently, Al, Ti, Zr and B were added to the melt. The melt was poured into the preheated cast iron mold. The ingot was soaked at 800° C. for 24 hours in order to remove thermal stresses resulting from the solidification of the ingot. The ingot is initially forged forge at a temperature of 1250° C. and finished at 900° C., the ingot forged into a rod of 15 mm of diameter. The forged rod was solution treated at 1280° C. for 3 hr. The test specimens were prepared from solution treated rod and then creep rupture test was carried out at 1000° C. under the stress of 5 $Kg/mm^2$. Table 1 shows the chemical composition of the alloy of the present invention compared with other Ni—Cr—W base alloys. Table 2 shows the result of creep rupture test of the alloy of the present invention in comparison with other Ni—Cr—W base alloys. Table 3 illustrates the result of corrosion test of the alloy of the present invention.

TABLE 1

Chemical composition of the alloy of the present invention compared with other Ni—Cr—W based alloys

| Alloy | Composition (wt %) | | | | | | | | |
|---|---|---|---|---|---|---|---|---|---|
| | Cr | W | Ti | Al | C | B | Zr | Ta | Ni |
| The present alloy | 23.0 | 21.2 | 0.69 | 2.22 | 0.05 | 0.004 | 0.1 | 0.52 | bal. |
| US 4,810,466 | 14.7 | 20.0 | 0.54 | 1.94 | 0.05 | 0.001 | 0.08 | 0.51 | bal. |
| GB 2103243A | 23.6 | 18.1 | 0.53 | — | 0.057 | — | 0.02 | — | bal. |

TABLE 2

The result of creep rupture text under the condition of 1000° C., 5 kg/mm$^2$

| Alloy | Creep repture life (hr) | Elongation (%) |
|---|---|---|
| The present alloy | 1,052 | 51.0 |
| US 4,810,466 | 290 | 11.0 |
| GB 2103243A | 190(1) | — |

(1)Extrapolated value from FIG. 3 in the GB 2103243A

TABLE 3

Corrosion preperties of the present invention compared with other Ni—Cr—W based alloys

| Alloy | Oxidation(1) | conc. HCl(2) | conc. $H_2SO_4$(2) | conc. $HNO_3$(2) | conc. $H_3PO_4$(2) | conc. $CH_3COOH$(2) |
|---|---|---|---|---|---|---|
| The present alloy | Excellent | Good | Average | Excellent | Good | Excellent |
| US 4,810,466 | Excellent | Good | Average | Excellent | Average | Good |
| Hastelloy X | Excellent | Good | Average | Poor | Good | — |

(1)Oxidation condition: 100 hours at 1000° C. in the air.
(2)Dipping condition: 24 hours at the boiling point of each concentrated acid solution.

What is claimed is:

1. An Ni—Cr—W base alloy consisting essentially of: by weight 21 to 25% of Cr, 18 to 25% of W, 0.5 to 2.0% Ti, 1 to 5% of Al, between zero and 0.2% of B, 0.025 to 0.5% of C, between zero and 0.3% of Zr and 0.3 to 3.0% of Ta, the balance being substantially Ni.

2. The Ni—Cr—W base alloy of claim 1 wherein Cr is 23.0%, W is 21.2%, Ti is 0.69%, Al is 2.22%, C is 0.05%, B is 0.004%, Zr is 0.1%, Ta is 0.52% with the balance nickel.

3. The Ni—Cr—W base alloy of claim 1 wherein said alloy has a creep rupture life exceeding 1000 hrs. when tested under conditions of 1000° C. and 5 Kg/mm$^2$.

4. The Ni—Cr—W alloy of claim 1 wherein said alloy has an elongation exceeding 50%.

5. The Ni—Cr—W alloy of claim 1 wherein said alloy has improved creep rupture strength and high workability by adjustment of Cr and B.

6. The Ni—Cr—W base alloy of claim 2 wherein said alloy has a creep rupture life exceeding 1000 hrs. when tested under conditions of 1000° C. and 5 Kg/mm$^2$ and an elongation exceeding 50%.

* * * * *